United States Patent [19]

Moestue

[11] 4,058,059

[45] Nov. 15, 1977

[54] MECHANISM FOR CLEANING A CYLINDER OF A PRINTING PRESS

[76] Inventor: Hans Jacob Moestue, Osteraskroken 9, N-1345 Osteras, Norway

[21] Appl. No.: 612,324

[22] Filed: Sept. 11, 1975

[30] Foreign Application Priority Data

| | | |
|---|---|---|
| Sept. 11, 1974 | Norway | 743261 |
| Aug. 22, 1975 | Norway | 752534 |
| Aug. 27, 1975 | Germany | 2538105 |

[51] Int. Cl.[2] ..... B41F 35/02

[52] U.S. Cl. ..... 101/425; 101/168

[58] Field of Search ..... 101/148, 156, 160, 161, 101/162, 164, 165, 166, 167, 168, 228, 350, 366, 361, 425, DIG. 8; 15/256.5, 256.51, 256.53, 256.6, 256.52; 259/105; 242/105

[56] References Cited

U.S. PATENT DOCUMENTS

| | | | |
|---|---|---|---|
| 282,995 | 8/1883 | Lee | 101/167 |
| 635,979 | 10/1899 | Read | 101/168 |
| 1,468,530 | 9/1923 | Voorhis | 161/156 |
| 1,736,402 | 11/1929 | Hawkins | 101/168 |
| 1,815,700 | 7/1931 | Bryan | 101/168 |
| 1,968,980 | 8/1934 | Aitchison | 101/156 |
| 1,970,809 | 8/1934 | Marquardt | 101/156 |
| 2,525,982 | 10/1950 | Wescott | 101/425 |
| 3,309,993 | 3/1967 | Grembecki | 101/425 |
| 3,404,627 | 10/1968 | Hallry | 101/228 |
| 3,411,444 | 11/1968 | Boneschi | 101/425 |
| 3,536,571 | 10/1970 | Grundman | 101/228 |
| 3,567,153 | 3/1971 | Becker et al. | 242/207 |

FOREIGN PATENT DOCUMENTS

| | | | |
|---|---|---|---|
| 169,826 | 10/1921 | United Kingdom | 101/160 |

*Primary Examiner*—Louis G. Mancene
*Assistant Examiner*—Paul J. Hirsch
*Attorney, Agent, or Firm*—Watson, Cole, Grindle & Watson

[57] ABSTRACT

An improved mechanism for cleaning the driven roller in a printing press is described. In the mechanism, a wash cloth may be fed from a magazine roller over a pressure roller to a take-up roller. The pressure roller may be brought to bear against the surface of the cylinder with the wash cloth therebetween. The wash cloth is wet by spraying cleaning fluid thereon immediately prior to its encountering the pressure roller. The wet wash cloth is thus brought into contact with the surface of the cylinder which is then rotated against the cloth to cleanse the surface. After the surface is clean, dry cloth may be brought into contact with the cylinder by merely not activating the fluid spray. Means are provided for driving the pressure roller through a constant angle at each change of the cloth and, via a slip clutch, for maintaining a consistent tension on the cloth regardless of the length of cloth collected on the take-up roller.

11 Claims, 12 Drawing Figures

Fig.1
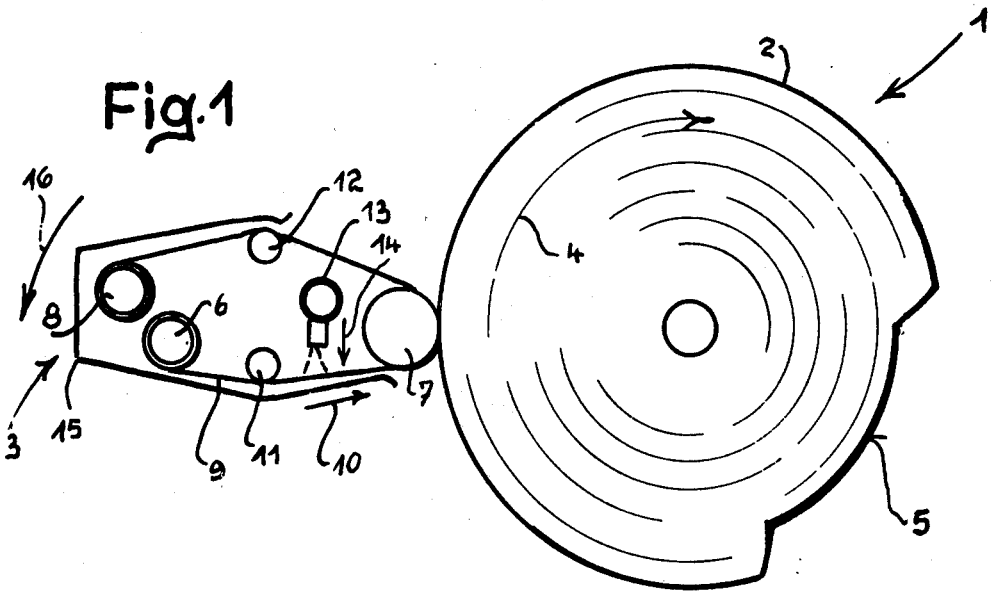
Fig.2
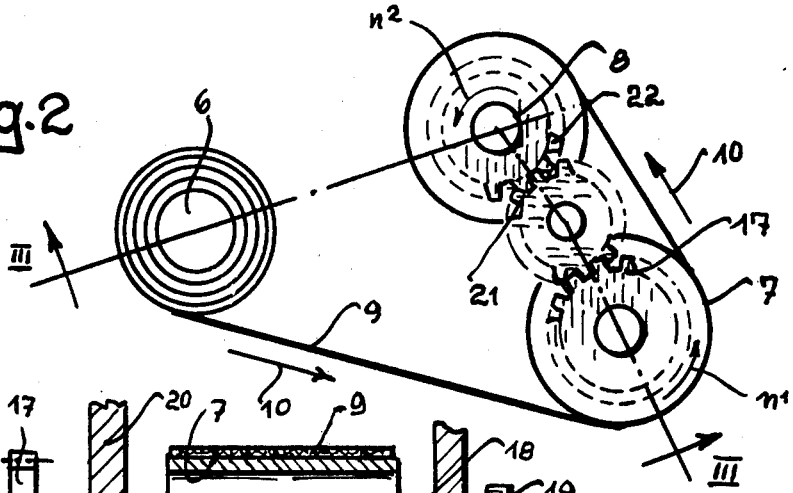
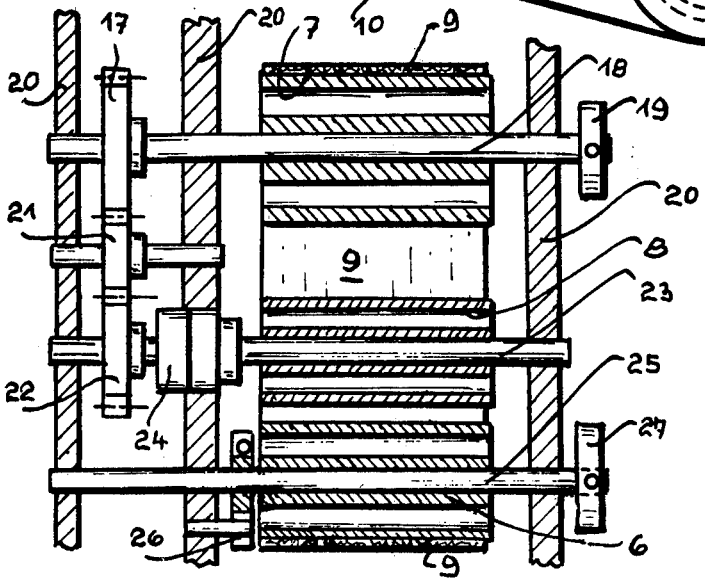
Fig.3

MECHANISM FOR CLEANING A CYLINDER OF A PRINTING PRESS

BACKGROUND OF THE INVENTION

Field of the Invention

The invention concerns a device for cleaning a driven cylinder of a printing press by means of a wash cloth which is unwound gradually by a magazine roller, is moistened with a cleaning fluid, is conducted over a pressure mechanism pressed against the cylinder to be cleaned and is wound up on a take up roller.

The cylinders of the printing presses and especially their rubber cylinders get dirty during the operation of the printing press after a certain time and must then be cleaned. When compared with known cleaning mechanisms which work with rotating brushes, wetted with a washing liquid, which lie against the cylinder to be cleaned, U.S. Pat. No. 2,525,982 has brought about some progress because, in accordance with the characteristics named at the outset, a wash cloth, gradually wetted with a cleaning fluid is applied to the surface to be cleaned of the concerned cylinder. In the case of the named U.S. patent, however, it is disadvantageous that the pressure mechanism is designed as a pad, which by means of a control mechanism applies the wash cloth to the surface of the cylinder to be cleaned. In cross-section, the pad is T-profiled, so that the cleaning fluid can be fed onto an attachment facing away from the surface to be cleaned. With this arrangement, no precise time-oriented control of the wetting of the wash cloth is possible, because the washing fluid must constantly traverse the distance from the wick-like pad to the rear side of the wash cloth. A certain amount of washing fluid is contantly being collected in this wick-like pad, which goes to the wash cloth and from there is applied to the surface of the cylinder to be cleaned. Thus, it is also not possible to rub the cylinder to be cleaned dry, i.e., with a dry wash cloth part it is not possible to carry out the described relative movement between the cylinder and the wash cloth. Finally, it is disadvantageous because the pressure pad is not moved along with the gradual forward movement of the wash cloth; therefore, additional forces are exerted on the wash cloth. On the other hand, the wash cloth must be porous in order to be able to absorb sufficient washing fluid.

Moreover, it is disadvantageous in the case of the above-named mechanism that the drive for gradual transport of the wash cloth onto the take-up roller is provided in such a manner that it is transported at each step through the same angle of rotation. With the changing diameter of the wash cloth on the take-up roller, a different length of wash cloth is conducted past the pressure pad and, thus, is used for the cleaning operation. The rotating step for the drive of the take-up roller must be so designed that at the start of the take-up operation, when there is only a small amount of wash cloth on the take-up roller, a sufficient length of wash cloth is transported by this rotating step. The result of this is, however, that ever increasing amounts of wash cloth are used up with each subsequent rotation step, and an unnecessarily large amount of wash cloth is used up.

SUMMARY OF THE INVENTION

The present invention avoids these disadvantages. The object of the present invention is to propose a mechanism of the type named at the outset with which it is possible to clean the dirty surface of a printing press cylinder very well with a optimally small consumption of wash cloth.

To solve this problem, the present invention is characterized by the fact that the pressure mechanism is designed as a pressure roller which is rotated through a constant angle over a pawl drive for each transport step of the wash cloth, whereby a gearing arrangement with slip clutch connects the pressure roller with the take-up roller in such a manner that the angle of rotation of the take-up roller is either larger or smaller than that of each equal step of the pressure roller.

Through these measures the wash cloth is transported through one and the same length with each transport step, regardless of the amount of wash cloth on the take-up roller, whereby the wash cloth is pressed against the cylinder by means of a driven pressure roller, The wash cloth remains constantly taut independent of the length of wash cloth on the take-up roller or on the magazine roller, without impermissibly high forces being exerted on the wash cloth.

In order to prevent an unintentional unrolling of the magazine roller, it is preferable that a locking pawl be provided for the magazine roller, which unlocks the magazine roller through a linkage in time before actuating the pawl drive. By this means, the magazine roller is unlocked before the pawl gear again engages the pressure roller.

It is preferable if the linkage is connected with a locking pawl for the pressure roller, This assures that the pressure roller cannot be rotated unintentionally. In special cases, the described locking of the pressure roller by the locking pawl can be eliminated.

In the case of an unlocked magazine roller and very slight inner friction of the conveying system of the device, an undesired unrolling of the wash cloth from the magazine roller can occur due to the force-locking rolling up of the wash cloth on the take-up roller. To prevent this, it is also preferable that a brake engage the shaft of the magazine roller. Its braking force is preferably adjustable.

In order to prevent the pressure roller from being driven when the supply of wash cloth on the magazine roller comes to an end, or when it is completely used up, a sensing mechanism can be provided which produces a signal as soon as the supply of wash cloth on the magazine roller goes below a predetermined length, which signal then halts the drive for the forward movement of the wash cloth.

There are several possibilities for this sensing mechanism. An especially operationally safe sensing mechanism is characterized by the fact that it has a feeler which lies against the wash cloth on the magazine roller and triggers a signal when it moves into a predetermined position.

Another embodiment of the sensing mechanism is characterized by the fact that it has a reflex head, which directs a light beam to a shaft of the magazine roller, and triggers a signal whenever there is a change in the light reflected therefrom.

Other embodiments can be controlled capacitatively, or by the number of winding revolutions. Also, the sensing can take place indirectly over the full take-up roller.

Another important object of the invention is that a control mechanism is provided which transports the wash cloth, when the pressure roller finds itself over the groove of the cylinder to be cleaned. This assures that the pressure roller and, thus, the wash cloth, lies against the cylinder and washes it during the entire remaining revolution of the cylinder to be cleaned (with the exception of the groove). The lifting of the mechanism from the cylinder is thereby dispensed with. This time is a gain for the cleaning process, so that a complete cylinder cleaning operation can be undertaken during the smallest number of cylinder revolutions. For this reason, the cleaning can take place in the so-called crawling motion of the printing press, in which the cylinder to be cleaned turns very slowly. During this cleaning time, the printing press operator can carry out other work, for example, he can clean other parts of the printing press or he can prepare the printing press for the next printing operation.

In order to create a especially simple embodiment form of the mechanism constructionwise, in which the locking pawls on the pressue roller and the magazine roller are eliminated, and in which, similar to the case of the aforementioned U.S. patent, the take-up roller is driven gradationally, the embodiment is characterized by the fact that the pressure mechanism is designed as a pressure roller and that a correcting mechanism is provided, which changes the lift of the pawl drive independently of the diameter of the wash cloth on the take-up roller. Also, in this way the wash cloth is transported further by constant lengths. The aforementioned locking pawls on the pawl drive working as transport pawls for the take-up roller are reduced, however. The transport mechanism of the wash cloth must be such that the wash cloth is transported opposite to the rotational direction of the cylinder to be cleaned, so that the necessary tension of the wash cloth is brought about over the frictional contact between the cylinder surface and the wash cloth.

In the following detailed description of the preferred embodiments, the invention will be explained in more detail by means of specific examples, from which other important characteristics of the invention can be derived.

BRIEF DESCRIPTION OF THE DRAWING

In the drawing:

FIG. 1 shows, in a schematic side view, the important structural elements of a device according to the present invention to explain the fundamental method of operation of this mechanism;

FIG. 2 shows, in a similar schematic side view, the magazine roller, the pressure roller and the take-up roller of the mechanism with details of the device to achieve the necessary cloth tension;

FIG. 3 shows a cross-section taken along Line III—III of FIG. 2;

DETAILED DESCRIPTION OF THE PREFERRED EMBODIMENTS

Figure 4:
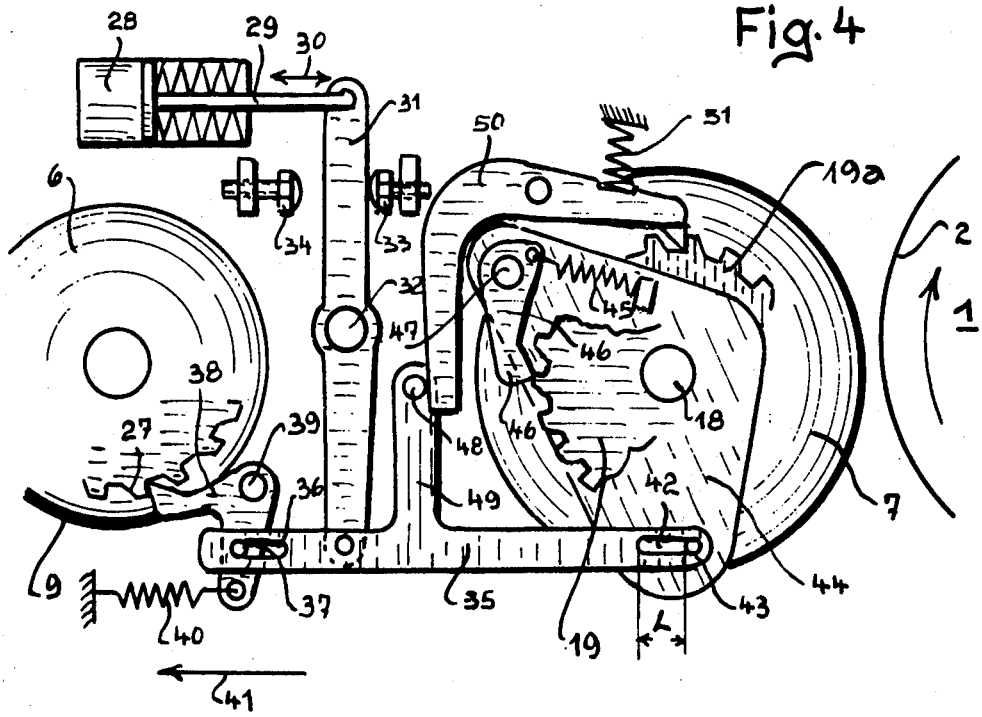
FIG. 4 shows other details of the mechanism, namely the gearing to achieve the step control with locking of the magazine roller and the pressure roller.

In referring to the various figures of the drawings hereinbelow, like reference numerals will be used to refer to identical parts of the apparatus.

Initially, to explain the fundamental method of operation of a mechanism according to the invention, reference is made to FIG. 1. There, a cylinder indicated by the reference numeral 1 is shown, whose surface 2 is to be cleaned by means of a mechanism designated generally by the reference numeral 3. The cylinder 1 rotates clockwise in the direction of the arrow 4 and has a cylindrical groove 5 in the surface 2.

The device 3 is comprised generally of a magazine roller 6, a pressure roller 7, and a take-up roller 8. A commercial wash cloth 9 is unwound from the magazine roller 6, is transported in the direction of the arrow 10, and is guided over the pressure roller 7 to the take-up roller 8 on which the consumed wash cloth is wound up. In so doing, the wash cloth is conducted over a series of guide rollers 11 and 12. Directly in front of the pressure roller 7 and directed toward the fresh wash cloth 9, there is a spray tube 13 for a commercial cleaning fluid. The cleaning fluid is sprayed from the spray tube 13 in the direction of the arrow 14 on the inside of the wash cloth directly before the contact of the wash cloth 9 with the pressure roller 7. The housing for the mechanism 3 is designated generally by the reference numeral 15.

The method of operation of the mechanism is as follows: A magazine roller 6 is supplied with a fresh wash cloth thereon. The wash cloth 9 is applied in the manner shown in FIG. 1 by guiding it around the rollers 11, 7, 12, and 8 sucessively and is fastened to the take-up roller 8. For this reason, the mechanism 3 is disconnected from the cylinder 1 by moving the mechanism in the direction of the arrow 16, so that there is room between the pressure roller 7 and the surface 2 of the cylinder 1.

If the surface 2 is to be cleaned, the mechanism 3 is brought into the position shown in FIG. 1 by moving it in the direction opposite to the arrow 16, so that the wash cloth 9 is pressed against the surface 2 by the pressure cylinder 7. Cleaning fluid is sprayed onto the wash cloth by the spray tube 13. A pawl drive which will be explained in more detail herebelow drives the pressure roller 7 counterclockwise through a pre-determined angle, so that the wash cloth 9 wetted with washing fluid comes to rest on the surface 2. In this position, the cylinder 1 turns in the direction of the arrow 4, and indeed one or several complete revolutions may be made. Subsequently, the mechanism 3 is disengaged from the surface 2 by turning it in the direction of the arrow 16, and a new clean section of the wash cloth 9 is brought to the pressure roller by actuating the pawl drive thereof. By actuating a standard control mechanism, which is not described in more detail, for applying the cleaning fluid, this new piece of wash cloth is also wetted with cleaning fluid, so that by repeating the described operation, the surface 2 can be cleaned several times or until it is completely cleaned.

Subsequently, the surface 2 is rubbed dry. This is accomplished by disconnecting the mechanism 3 from the surface 2 by moving it in the direction of the arrow 16 and subsequently moving forward a dry section of the wash cloth 9 in the direction of the arrow 10, so that after reengaging the mechanism 3, a dry wash cloth comes to rest on the surface 2. Thereafter, the cylinder 1 rotates completely one or more times. As described previously with regard to the washing step, this operation can be repeated several times with successive dry sections of wash cloth until the surface 2 is completely dry. Subsequently, the mechanism 3 is again disengaged and its drive is shut-off. The cleaning operation is then concluded.

In the following description, more details of the mechanism will be explained by means of FIGS. 2 and 3. A pawl drive, as will be explained in more detail later on, engages the pressure roller 7 and turns it at every gear step through a certain angle of rotation $n_1$. For this purpose, a gear wheel 17 sits on a shaft 18 of the pressure roller 7 (see also FIG. 3). The pawl drive is indicated generally in FIG. 3 by the reference numeral 19.

Another gear wheel 21 rotatably mounted in the support 20 of the mechanism mates with the gear wheel 17. The gear wheel 22, in turn, mates with another gear wheel 21, which is fixedly connected to the shaft 23 of the take-up roller 8. The ratio between the gear wheels 17, 21 and 22 is selected such that the take-up roller 8 is turned with each movement of the pressure roller 7 through an angle of rotation about ten times that of the pressure roller 7.

The transmission of force between gear wheel 22 of the take-up roller 8 and the take-up roller 8 itself takes place via a slip clutch 24.

A brake 26 engages the shaft 25 of the magazine roller 6. This will be explained in more detail later on in connection with FIG. 5. In addition, a pawl catch 27 rides on the shaft 25, which will be explained in more detail in connection with FIG. 4.

By means of the measures described in connection with FIGS. 2 and 3, it is assured that independently of the winding diameter of the take-up roller 8, the take-up roller 8 always rotates faster than the driven pressure roller 7. Its larger angle of rotation is compensated by the slip-clutch 24. Because of the brake 26 on the magazine roller 6, the wash cloth 9 remains constantly taut between the three rollers 6, 7 and 8.

In the following description, the stepwise control will be explained in more detail by means of FIG. 4. This control consists of a step-by-step cylinder 28, whose piston rod 29 can be moved in a controlled manner in the direction of a double arrow 30. A double-armed lever, whose axis of rotation is indicated at 32, 31 is flexibly connected at one end to the piston rod 29. The lever 31 is movable between the adjustable stops 33 and 34.

A rod 35 is flexibly connected with the lower end of the lever 31. On one end of the rod 35, there is a slotted hole 36, in which there is a pin 37 of a locking pawl 38. The pawl 38 can be rotated about a position 39. The locking pawl 38 is drawn by means of a spring 40 in the direction of the arrow 41 onto the pawl catch 27.

Another slotted hole 42 is provided on the other end of the rod 35 in which a pin 43 of a pawl shield 44 can be moved. The pawl shield 44 is rotatable about the shaft 18 of the pressure roller 7. One end of a compressed spring 45 is fastened to the pawl shield 44. The other end of the compressed spring 45 presses on a lever arm of a transport pawl 46, which is rotatable about position 47 and whose free end meshes with the gear wheel of the pawl drive 19.

The rod 35 has a central extension 49 on which a pin 48 is fastened. Another double-armed pawl 50 lies against the pin 48, whose free end is pressed against the teeth of a ratchet wheel 19*a* by a pressure spring 51.

The mechanism described in connection with FIG. 4 operates in the following manner. If the step-by-step cylinder 28 receives a pressurized air impulse such that its piston rod 29 is drawn to the left in the view of FIG. 4, then the lever 31 moves around its axis of rotation 32 in a counterclockwise direction. This causes the rod 35 to be moved to the right. The pin 37 is thus moved along to the right by the slotted hole 36. Therefore, the pawl 38 is rotated in a counterclockwise direction and releases the pawl lock 27 and the magazine roller 6. After the conclusion of a stroke at length L, the pawl shield 44 is then moved in a counterclockwise direction, so that its pin 43 comes to rest on the left boundary of slotted hole 42. As a result, the pawl drive 19 and the pressure roller 7 are moved a single step forward by the pressure spring 45 and the pawl lever 46.

Before the gradual rotation of the pressure roller 7, the pawl 50 is also moved in a counterclockwise direction over pin 48 and thereby releases the pawl drive 19*a* of the pressure roller 7. This locking feature of the pressure roller 7 by the pawl 50 can be eliminated in special cases.

Figure 5:
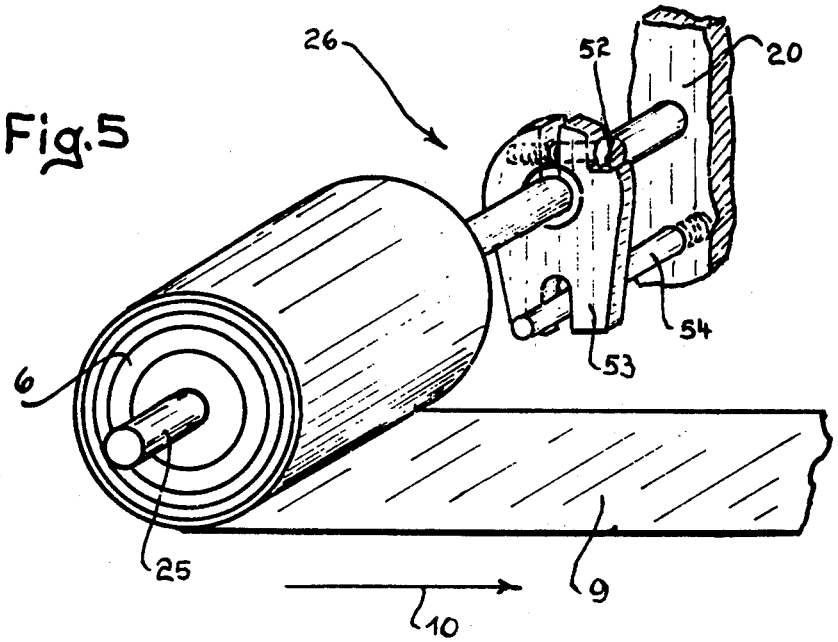
FIG. 5 is a perspective schematic view of a braking mechanism for engaging the shaft of the magazine roller.

FIG. 5 shows the details of the brake 26 when it is engaging the shaft 25 of the magazine roller 6. This brake consists of a brake shoe, whose braking force is adjustable with a screw 52. A fork 53 is designed on the other end of the brake shoe, into which there is inserted a pin 54 whose other end is firmly attached to the support 20. The counter-moment of the braking force is thus transmitted from the support through the pin 54 to the brake 26 and from there to the shaft 25.

Figure 6:
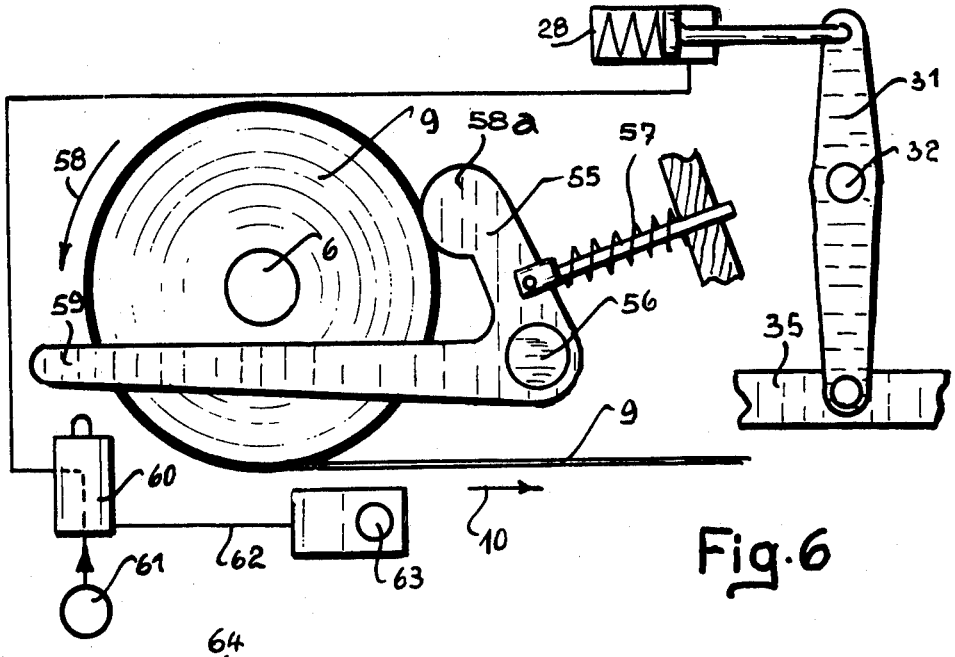
FIG. 6 is a side elevation view of an embodiment of a sensing mechanism for the magazine roller.
Figure 7:
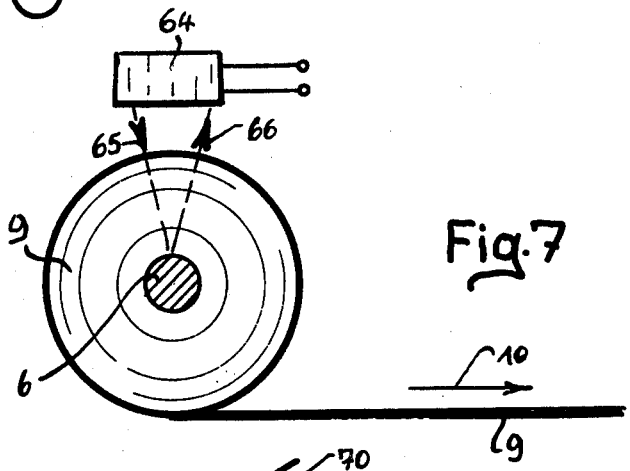
FIG. 7 shows another embodiment of the sensing mechanism.

FIGS. 6 and 7 show the details of a pair of sensing mechanisms for the magazine roller. FIG. 6 shows a mechanical solution and FIG. 7 shows an optical solution.

In FIG. 6, a double-armed feeler member 55 is rotatable about a shaft 56. The feeler member 55 is pressed by a spring 57 on one end 58*a* against the surface of the wash cloth 9 located on the magazine roller 6. As the cleaning operation proceeds, the wash cloth is used up and its diameter is reduced on the magazine roller. Due to this, the feeler member 55 rotates counterclockwise in the direction of the arrow 58. If only a small amount of wash cloth 9 remains on the magazine roller 6, then the other end 59 of the feeler member 55 actuates a control valve, through which pressurized air is fed from a pressurized air source 61 to the step-by-step cylinder 28 (see also FIG. 4) in such a way that its operation is eliminated. Simultaneously, an alarm mechanism 63 can be actuated by a signal on a wire 62.

In the embodiment shown in FIG. 7, a reflex head 64 is provided, which directs a beam of light 65 toward the magazine roller 6. As soon as there is no longer any wash cloth 9 over the magazine roller 6, the reflection conditons for the light beam 65 are changed and the reflected light beam 66 generates an electrical signal at a photosensitive surface in the reflex head 64 as a result of the change in the reflection conditions. The signal is used in the described manner to halt the stepped drive for the pressure roller 7.

Figure 8:
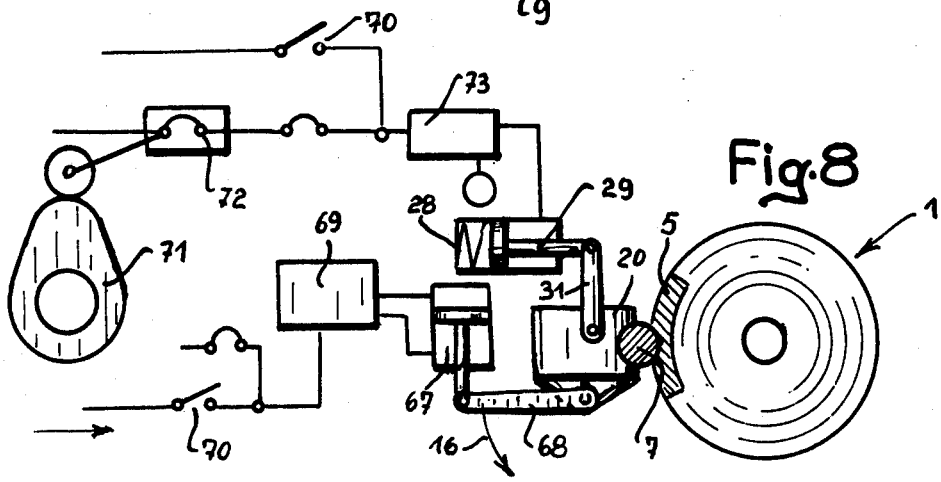
FIG. 8 is a schematic side view of a mechanism which causes the pawl transport for the pressure roller to be engaged only when the pressure roller is located opposite the groove of the cylinder to be washed.

FIG. 8 is a schematic representation of a control mechanism in which the stepped drive for the pressure roller 7 is only turned on when the pressure roller 7 is located over the cylinder groove 5 of the cylinder 1. During the normal running of the program, the previously described manner of turning on and off of the mechanism 3 takes place by movement in the direction of the arrow 16 and in the opposite direction of the arrow 16 by means of an air cylinder 67, which moves the lever 68 and thus the mechanism 3 correspondingly. The air cylinder 67 has pressure applied to it by an electromagnetic valve 69. A switch 70 turns the electromagnetic valve on and off.

If the main program should be turned off, the lifting of the device 3 from the cylinder 1 is stopped. The normal washing program effected through the switch 70 is interrupted and the air cylinder 67 is switched to an installation position. Therefore, the electromagnetic valve 69 is separated from the general program.

The information concerning the length of the cylinder groove 5 and its temporal relationship to the washing mechanism 3 is generated through a limit switch controlled with a cam 71. The cam 71 can be adjusted to the actual groove length. Only during the periods of time in which the cylinder groove 5 is located on the pressure cylinder 7 does a command come from the cam 71 for the step-by-step switching of the wash cloth transport to the air cylinder 28 (see also FIG. 4), through an electromagnetic valve 73. Thereafter, the washing program runs its course normally with drying and wetting, preferably during the crawling operation of the cylinder 1. The cam 71 is connected fixedly to the shaft of the cylinder 1.

Figure 9:
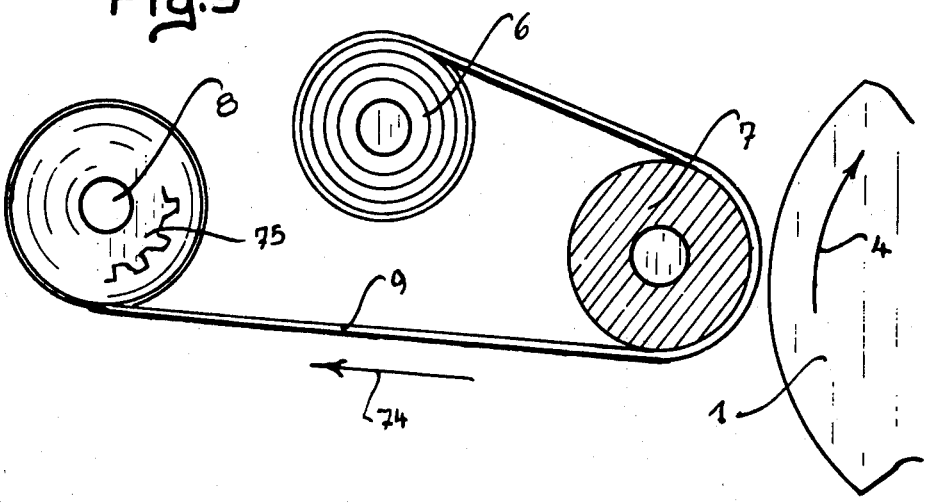
FIG. 9 is a view similar to FIG. 2 which shows another embodiment, altered from the former one, in which the take-up roller is driven.
Figure 10:
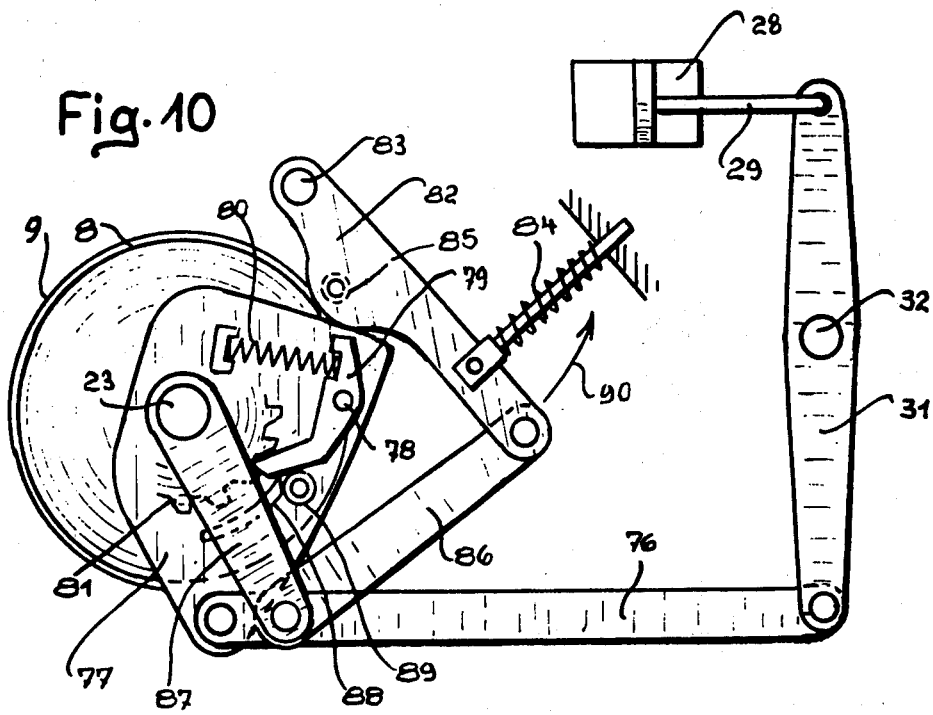
FIG. 10 shows the mechanism according to FIG. 9 with an additional correcting mechanism, which changes the lift of the pawl drive independently of the diameter of the wash cloth on the take-up roller.

Turning to FIGS. 9 and 10, an embodiment of the mechanism will be described in which not the pressure roller, but rather, the take-up roller 8 is driven gradually. In contrast to the arrangement in FIG. 1, in these Figures, the position of the magazine roller 6 and of the take-up roller 8 are transposed. While the rotational direction of cylinder 1 remains the same, i.e., in the direction of the arrow 4, the transport of the wash cloth 9 in the case of the embodiment of FIGS. 9 and 10 takes place in the direction of the arrow 74, i.e., opposite to the direction of the arrow 10 in FIG. 1. When the pressure roller 7 is applied against the cylinder 1, a movement takes place over the driven cylinder 1 in the opposite direction of arrow 74 against the wash cloth or the polishing cloth 9. The gears 17, 21, and 22 explained in connection with FIGS. 2 and 3 are arranged between the rollers 6 and 8 in FIG. 9. A pawl drive 75 is provided on the take-up roller 8 which fundamentally operates like the pawl drive 19 and 46 which was described in connection with FIG. 4.

Insofar as the disadvantage remains that with increasing consumption of the wash cloth roll, increasing lengths of wash cloth are used for the washing process, the drive used in FIG. 9 can be used. It is preferable, however, if a correction mechanism is provided which assures that the same lengths of wash cloth pieces are used for each washing operation independently of the actual winding diameter, this will be explained for the means shown in FIG. 10.

Therefore, a rod 76 is rotatably connected to one end of a double-armed lever 31 (see FIG. 4) whose opposite end is connected in a rotatable manner to a pawl shield 77 corresponding to the pawl shield 44 of FIG. 4. In turn, an axis pin 78 is firmly connected to the pawl shield 77, around which a transport pawl 79 can be swivelled. The free end of the pawl transport is under the effect of a pressure spring 80 thereby meshing with the teeth of a ratchet wheel 81 which is firmly connected to the shaft 23 of the take-up roller 8. As a result, the ratchet wheel 81 and,thus, the take-up roller 8 are rotated by the pitch of a tooth with each stroke of the step-by-step cylinder.

A feeler lever 82 is mounted swivellably around the axis 83 fastened to the housing for the aforementioned correction mechanism. A feeler lever 82 is pressed by a compressed spring 84 against the cloth 9 on the take-up roller 8. The nose 85 of the feeler lever 82 thus always lies on the outside of the cloth 9.

A member 86 is connected rotatably with the free end of the feeler lever 82 and the other end is connected rotatable to another lever 87. The lever 87 is mounted in a rotatable manner around the shaft 23 and which has a correction curve member 88 affixed thereto. A roller 89 on the transport pawl 79 lies on this correction curve.

When the diameter of the cloth on the take-up roller 8 becomes larger, the feeler lever 82 is moved in the direction of the arrow 90. In this way, the roller 89 travels along the correction curve member 88 thereby achieving the desired correction.

Experience has shown that the wash cloth often can be used twice. For this reason the operator should be given the possibility of rewinding the wash cloth without having to remove it from the machine.

Figure 11:
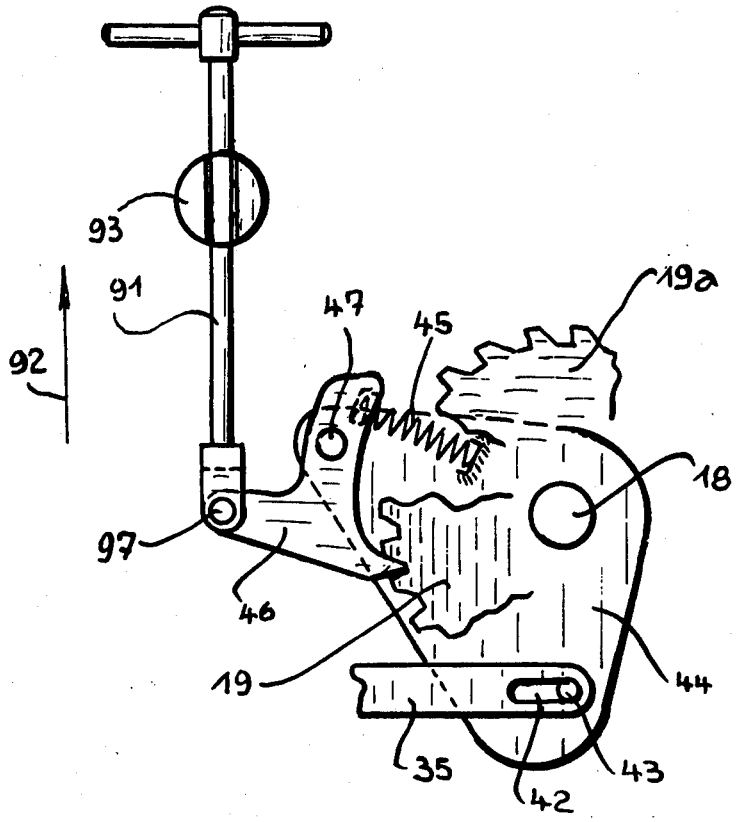
FIG. 11 is a side view similar to FIG. 4 which is useful for explaining other details of the invention.
Figure 12:
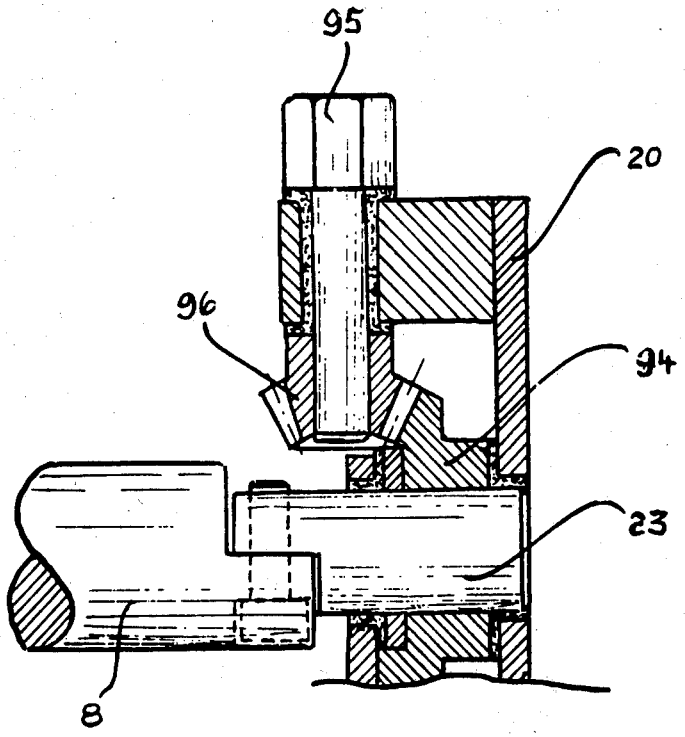
FIG. 12 shows a partially cut-off view according to FIG. 3.

FIGS. 11 and 12 show that for this purpose, the ratchet lever 46 of the transport pawl mounted on the pawl shield 44 can be lifted up by a pull rod 91 in the directon of the arrow 92. The ratchet lever 46 is disconnected thereby from the pawl wheel 19. The pull rod 91 is mounted slidably through a bolt 93 so that it can follow the control movement during normal operation (see FIG. 11). It is flexibly connected to a ratchet lever 46 over link pin 97.

FIG. 12 depicts a cone drive 94 is affixed to the shaft 23 of take-up roller 8 so that the wash cloth 9 can be rewound from the take-up roller 8 to the magazine roller 6 through rotation of a crank member 95. For this purpose, the cone drive 94 meshes with a bevel gear 96 affixed to the crank member 95.

By means of this arrangement, the operator also has the possibility of rewinding that part of the wash cloth which was used for drying during the preceding washing operation. As a result, the wash cloth can be better and more fully utilized.

I claim:

1. A mechanism for cleaning a driven cylinder of a printing press comprising a wash cloth web. a magazine roller from which the wash cloth web is incrementally unwound, means for wetting the wash cloth web with a cleaning fluid, a pressure mechanism which may be pressed against the cylinder to be cleaned and over which the wash cloth web is conducted, a take-up roller upon which used portions of the wash cloth web are wound up, and means for moving the pressure mechanism into and out of contact with the cylinder, the pressure mechanism including a pressure roller, drive means for moving the pressure roller through a constant angle for each increment of the wash cloth web, and secondary drive means including a slip clutch connecting the pressure roller to the take-up roller, the secondary drive means being such that the angle of rotation of the take-up roller subtends an arc the length of which is at least equal to the length of arc subtended by the concurrent angle of rotation of the pressure roller whereby a constant predetermined tension is maintained in the wash cloth web.

2. A mechanism according to claim 1, wherein there is further included a sensing means which generates a signal as soon as the supply of wash cloth web on the magazine roller goes below a predetermined length, which signal stops the drive means from moving the wash cloth web forward.

3. A mechanism according to claim 2, wherein the sensing means includes a sensing lever which lies against the wash cloth web on the magazine roller and triggers a signal when moved into a predetermined position.

4. A mechanism according to claim 2, wherein the sensing means includes a reflex head which directs a light beam toward the magazine roller and which triggers a signal with a change of the light reflected therefrom.

5. A mechanism according to claim 2, wherein there is further included a control means for incrementally advancing the wash cloth web when the pressure roller is located over an axial groove in the cylinder to be cleaned.

6. A mechanism according to claim 1, wherein the drive means includes a pawl drive connected to the pressure roller.

7. A mechanism according to claim 6, wherein the drive means further includes means for actuating the pawl drive.

8. A mechanism according to claim 7, wherein the means for actuating is an air cylinder connected to a lever member of the pawl drive.

9. A mechanism according to claim 6, wherein there is further included a locking pawl operatively associated with the magazine roller and a linkage connected thereto for unlocking the magazine roller before actuating the pawl drive for the pressure roller.

10. A mechanism according to claim 9, wherein the linkage is also connected to a locking pawl for the pressure roller.

11. A mechanism according to claim 10, wherein there is further included a brake means which meshes with a shaft connected to the magazine roller.

* * * * *